US009528804B2

(12) United States Patent
Amick

(10) Patent No.: US 9,528,804 B2
(45) Date of Patent: Dec. 27, 2016

(54) BALLISTIC ZINC ALLOYS, FIREARM PROJECTILES, AND FIREARM AMMUNITION CONTAINING THE SAME

(71) Applicant: Amick Family Revocable Living Trust, Albany, OR (US)

(72) Inventor: Darryl D. Amick, Albany, OR (US)

(73) Assignee: Amick Family Revocable Living Trust, Albany, OR (US)

( * ) Notice: Subject to any disclaimer, the term of this patent is extended or adjusted under 35 U.S.C. 154(b) by 37 days.

(21) Appl. No.: 14/280,450

(22) Filed: May 16, 2014

(65) Prior Publication Data

US 2015/0268019 A1 Sep. 24, 2015

Related U.S. Application Data

(60) Provisional application No. 61/855,697, filed on May 21, 2013, provisional application No. 61/950,577, filed on Mar. 10, 2014.

(51) Int. Cl.

| | |
|---|---|
| ***F42B 12/34*** | (2006.01) |
| ***F42B 8/14*** | (2006.01) |
| ***F42B 7/04*** | (2006.01) |
| ***F42B 12/74*** | (2006.01) |

(52) U.S. Cl.

CPC ..... *F42B 12/74* (2013.01); *F42B 7/046* (2013.01); *F42B 8/14* (2013.01); *F42B 12/34* (2013.01)

(58) Field of Classification Search

CPC ..... F42B 12/34; F42B 12/36; F42B 12/367; F42B 12/72; F42B 12/74; F42B 7/04; F42B 7/046; F42B 8/12; F42B 8/14; F42B 30/02

USPC ..... 102/439, 444, 501, 506, 507, 514, 516, 102/517, 529

See application file for complete search history.

(56) References Cited

U.S. PATENT DOCUMENTS

| | | | | |
|---|---|---|---|---|
| 3,037,859 A | | 6/1962 | Larrieu | |
| 5,527,376 A | | 6/1996 | Amick et al. | |
| 5,535,495 A | * | 7/1996 | Gutowski | B22D 17/00 86/54 |

(Continued)

FOREIGN PATENT DOCUMENTS

| | | | | |
|---|---|---|---|---|
| EP | 1167560 | | 1/2002 | |
| WO | WO2004/090464 | | 10/2004 | |
| WO | WO 2015053820 A1 | * | 4/2015 | F24B 12/74 |

OTHER PUBLICATIONS

International Search Report for PCT/US2014/038589; Dec. 2014.*

(Continued)

*Primary Examiner* — James S Bergin

(74) *Attorney, Agent, or Firm* — Dascenzo Intellectual Property Law, P.C.

(57) ABSTRACT

Firearm cartridges, firearm projectiles, and/or projectile components formed at least in part from a disclosed ballistic zinc alloy. These ballistic zinc alloys overcome shortcomings of other lead substitutes for firearm projectiles, including Zamak alloys and other conventional zinc alloys. In some embodiments, and as compared to a firearm projectile formed from a conventional zinc alloy, a ballistic zinc alloy firearm projectile has at least one of an increased ductility, an increased frangibility, and/or a decreased tendency to smear or gall within a rifled firearm barrel. In some embodiments, the ballistic zinc alloy is a zinc-aluminum alloy that includes additional alloy components that collectively enhance the properties of the ballistic zinc alloy for use in firearm projectiles.

26 Claims, 2 Drawing Sheets

(56) References Cited

U.S. PATENT DOCUMENTS

| | | | | |
|---|---|---|---|---|
| 5,824,944 | A | 10/1998 | Dippold et al. | |
| 5,831,188 | A | 11/1998 | Amick et al. | |
| 5,852,255 | A | 12/1998 | Hallis et al. | |
| 5,894,645 | A * | 4/1999 | Hallis | B21F 7/00 86/54 |
| 6,447,715 | B1 | 9/2002 | Amick | |
| 6,527,880 | B2 | 3/2003 | Amick | |
| 6,561,070 | B2 | 5/2003 | Weber | |
| 7,000,547 | B2 | 2/2006 | Amick | |
| 7,217,389 | B2 | 5/2007 | Amick | |
| 7,837,809 | B2 * | 11/2010 | Ferruelo Nicolas | C22C 1/0408 148/441 |
| 8,087,359 | B2 | 1/2012 | Sauvestre | |
| 2002/0056397 | A1 | 5/2002 | Carr et al. | |
| 2005/0188890 | A1 | 9/2005 | Tarrant | |
| 2008/0215017 | A1 | 9/2008 | Gergely et al. | |
| 2011/0014084 | A1 | 1/2011 | Winter et al. | |
| 2011/0203477 | A1 | 8/2011 | Amick | |
| 2012/0294756 | A1 * | 11/2012 | Yamaguchi | B24C 1/083 420/515 |
| 2012/0308426 | A1 | 12/2012 | Perez et al. | |

OTHER PUBLICATIONS

Written Opinion Of The International Searching Authority for PCT/US2014/038589; Dec. 2014.*

International Preliminary Report on Patentability for PCT/US2014/038589; Sep. 2015.*

* cited by examiner

BALLISTIC ZINC ALLOYS, FIREARM PROJECTILES, AND FIREARM AMMUNITION CONTAINING THE SAME

RELATED APPLICATIONS

This application claims priority to U.S. Provisional Patent Application Ser. No. 61/855,697, which was filed on May 21, 2013, and 61/950,577, which was filed on Mar. 10, 2014, the complete disclosures of which are hereby incorporated by reference for all purposes.

FIELD

The present disclosure is directed generally to firearm ammunition, and more particularly to firearm ammunition projectiles that are formed from a zinc alloy having improved properties.

BACKGROUND

Historically, lead projectiles have been utilized with firearms. Factors that contributed to this choice include lead's relatively high density (11.3 g/cc), workability, and inexpensiveness. However, under certain conditions, environmental and/or wildlife regulations may preclude the use of lead as a projectile due to the toxicity thereof. For example, an animal might ingest the lead projectile, an animal that has been shot with a lead projectile might be consumed by another animal, and/or the lead might act as an environmental contaminant. In addition, lead fumes and dust have been shown to cause health problems in people who routinely practice target shooting at indoor ranges. For example, these health problems may be experienced by law enforcement personnel who are required to maintain continuous proficiency in marksmanship.

When considering alternative materials to be utilized, consideration should be made about the frangibility and ductility of the resulting projectiles. For example, for firing ranges, and especially indoor ranges, a frangible projectile may be desired so that shooters and observers are not subjected to ricocheting or rebounding bullet fragments created when bullets strike hard targets, such as steel plates, at relatively close range (e.g., 25 yards, about 23 m). In such applications, it may be desirable to utilize projectiles that are highly frangible, i.e., which disintegrate into fragments small enough to not be a hazard to personnel. However, a competing consideration exists for limiting the size of the produced particles.

For some hunting and other outdoor shooting activities, there may be a desire for the projectiles to be sufficiently ductile so that the projectiles, or at least the nose portions thereof, expand or "mushroom" so as to increase the diameter of the projectile's wound path, thereby increasing trauma and lethality. In these applications, it is therefore advantageous that at least the nose of the bullet or other projectile, if not the entire projectile, be formed from a relatively ductile material. A further consideration, although not a requirement, when designing bullets and other projectiles for use in outdoor shooting activities is to select a composition that limits "sparking." Sparking refers to the tendency of a bullet to create sparks when it strikes a hard object, as these sparks may lead to fires. An example of a material that may exhibit undesirable sparking is steel.

Thus, alternative projectile materials have been pursued. However, finding commercially viable lead-substitutes and methods for forming firearm projectiles from these compositions has not been an easy task. Previously proposed lead-substitutes include steel, copper, tin, and bismuth, which are all much less dense than lead, as well as tungsten and its alloys, which are denser than lead. Firearm projectiles formed from these materials all have been utilized as substitutes for lead projectiles in firearm ammunition, with differing degrees of success. However, projectiles made from each of these materials suffer from disadvantages. As examples, these projectiles may damage a barrel of a firearm, may not produce desired ballistic properties (such as a shot pattern, a shot velocity, a shot penetration, and/or a shot trail when fired from a shotgun), and/or may be expensive to manufacture.

Thus, there exists a need for improved projectiles that may meet environmental and/or wildlife regulations regarding toxicity while also being economical to manufacture and producing desired ballistic properties.

Zinc is a particularly promising alternative to lead firearm projectiles by virtue of its environmental and hygienic safety, castability, and relatively low cost. Zinc alloys also generally are known for having relatively high strength and corrosion resistance, if properly formed. However, prior attempts to utilize zinc alloys to form firearm projectiles arguably have not lived up to this promising potential.

Many previous attempts to utilize zinc in nontoxic bullets have employed powder-metallurgical technologies in which metal powders are compacted at high pressures into desired shapes and sizes in closed dies, optionally followed by sintering to at least partially fuse the powder particles together. Such approaches, while marginally successful, have proven to be relatively expensive.

Early attempts to produce useful articles other than ammunition from cast zinc alloys met with various levels of success, due primarily to problems associated with the presence of even slight concentrations of impurities. For example, the presence of lead, even in amounts less than 0.01 wt % (weight percent) may result in a detrimental condition referred to as "zinc pest" which causes intergranular corrosion/oxidation, surface blisters, spalling and, eventually, complete disintegration of cast articles. Significant improvements in zinc refining by the New Jersey Zinc Company (circa 1929) resulted in high-purity zinc (99.99%) which, in turn, made successful alloy development possible throughout the world. One family of such alloys, originally developed in Germany, is referred to as "Zamak" or "Zamac." Zamak alloys all have a common concentration of approximately 4 wt % aluminum, with various intentional additions of magnesium, copper, and nickel. Table I presents chemical compositions (per ASTM B86/castings) for several Zamak alloys currently in use.

TABLE I

Chemical Compositions of Zamak Alloys

| Alloy | wt % | Al | Cu | Mg | Pb | Cd | Sn | Fe | Ni |
|---|---|---|---|---|---|---|---|---|---|
| Zamak- | min. | 3.5 | 2.6 | .025 | — | — | — | — | — |
| 2 | max. | 4.3 | 2.9 | .05 | .005 | .004 | .003 | .1 | — |
| Zamak- | min. | 3.5 | — | .025 | — | — | — | — | — |
| 3 | max. | 4.3 | .25 | .05 | .005 | .004 | .003 | .1 | — |
| Zamak- | min. | 3.5 | .75 | .03 | — | — | — | — | — |
| 5 | max. | 4.3 | 1.25 | .06 | .005 | .004 | .003 | .1 | — |
| Zamak- | min. | 3.5 | — | .005 | — | — | — | — | .005 |
| 7 | max. | 4.3 | .25 | .02 | .003 | .002 | .001 | .075 | .02 |

Zamak-3 is probably the most the common Zamak alloy, and is the standard to which other Zamak alloys are compared. Zamak-3 is castable and has long-term dimensional stability.

Zamak-2 has a composition similar to Zamak-3 with the addition of about 3 wt % copper. The additional copper increases strength by about 20% relative to Zamak-3. Zamak-2 has the greatest strength of all the common Zamak alloys. Over time, it retains its strength and hardness better than the other common alloys. Nonetheless, over time, it becomes more brittle, less elastic, and shrinks.

Zamak-5 has a composition similar to Zamak-3 with the addition of about 1 wt % copper. Zamak-5 has an increased strength (by approximately 10%), hardness, and corrosive resistance relative to Zamak-3. However, Zamak-5 has reduced ductility and dimensional stability relative to Zamak-3.

Zamak-7 has a composition similar to Zamak-3 but with less magnesium, stricter control of impurities, and added nickel. Zamak-7 has increased fluidity and ductility relative to Zamak-3. The added nickel contributes to reduced intergranular corrosion.

Mechanical properties of several Zamak alloys are summarized in Table II. Ultimate tensile strength, yield strength, and shear strength are expressed in megapascal units (MPa) and may equally well be expressed in other units such as kilo-pound force per square inch (ksi; 1 MPa≈0.145 ksi). Percent elongation at fracture (% elongation) is a measure of ductility and is used generally as a proxy to characterize ductility. Hardness is characterized with the Brinell indentation hardness test and values are expressed with the Brinell hardness number (BHN).

TABLE II

Mechanical Properties of Zamak Alloys

| | Zamak-2 (aged) | Zamak-3 (aged) | Zamak-5 (aged) | Zamak-7 |
|---|---|---|---|---|
| Ultimate Tensile Strength, MPa | 397 (331 aged) | 268 | 331 (270 aged) | 285 |
| Yield Strength, MPa | 361 | 208 | 295 | 285 |
| % Elongation | 6% | 6.3% (16% aged) | 3.6% (13% aged) | 14% |
| Shear Strength, MPa | 317 | 214 | 262 | 214 |
| Hardness, BHN | 130 (98 aged) | 97 | 114 | 80 |

An example of an attempt to utilize Zamak alloys for firearm projectiles is U.S. Pat. No. 5,535,495 to Gutowski, the disclosure of which is hereby incorporated by reference for all purposes. The '495 patent discloses methods for producing one particular type of zinc alloy bullet; namely, a frangible pistol bullet designed and intended for use in indoor ranges, such as those used by law enforcement officers and civilian target shooters. Several problems were encountered with bullets produced according to the disclosure of the '495 patent. A primary problem is that the produced bullets, which were produced from Zamak-3, did not fragment into particles small enough to meet the current Federal Law Enforcement Training Center (FLETC) recommendation for a maximum bullet (or bullet jacket) fragment weight of 5 grains (0.324 gram). Furthermore, the '495 patent discloses a required "sizing" operation, in which the die-cast bullet precursors are mechanically deformed after production to reduce the precursors to final dimensions and tolerances. Such "sizing" operations not only add cost to the finished bullets, but also have the potential to introduce both internal and external defects (e.g., cracks, seams, laminations, etc.) into the bullet. Some of these defects, if undetected, could have serious consequences, such as causing bullet fragments to become lodged in the gun barrel as obstructions. Subsequent rounds in a repeating weapon then have the potential to cause the firearm to fail, such as by bursting the receiver and/or barrel. Another concern with the bullets of the '495 patent is that no consideration was made for the fact that the zinc die-cast alloys utilized in the '495 patent inherently exhibit "aging" phenomena. Specifically, such copper-containing zinc alloys may exhibit measurable dimensional shrinkage (e.g., 0.1% during the first month) after formation. For cast parts requiring close dimensional tolerances, certainly including bullets, this shrinkage is not acceptable.

An example of an attempt to utilize cast zinc and zinc alloy wires to form firearm projectiles is U.S. Pat. No. 5,852,255 to Hallis et al., the disclosure of which is hereby incorporated by reference for all purposes. The '255 patent discloses frangible bullets formed from cast zinc wires that are swaged together and heated, but not sintered. The '255 patent discloses that the wires must be formed from 95 wt % zinc, and preferably from 99-99.99 wt % zinc.

Other prior attempts to form firearm ammunition from conventional zinc alloys produced unsuitable projectiles, such as due to "zinc pest." Zinc pest refers to the demonstrated incompatibility between lead and zinc, with even 0.01 wt % lead resulting in an unsatisfactory zinc alloy. This lead may be introduced, for example, when zinc alloys and/or projectiles are cast from equipment that has been used for casting lead and/or articles formed from lead.

SUMMARY

Firearm cartridges, firearm projectiles, and/or projectile components may be formed at least in part from a disclosed ballistic zinc alloy. These enhanced zinc alloys overcome shortcomings of other lead substitutes for firearm projectiles, including Zamak alloys and other conventional zinc alloys. In some embodiments, and as compared to a firearm projectile formed from a conventional zinc alloy, a ballistic zinc alloy firearm projectile has at least one of an increased ductility, an increased frangibility, and/or a decreased tendency to smear or gall within a rifled firearm barrel. In some embodiments, the ballistic zinc alloy is a zinc-aluminum alloy that includes additional alloy components that collectively enhance the properties of the ballistic zinc alloy for use in firearm projectiles.

Firearm cartridges, such as bullet cartridges and/or shot shells, include a casing adapted to be received into a firearm, a primer and a propellant within the casing, and a firearm projectile at least partially received into the casing. The firearm projectiles include a ballistic zinc alloy with enhanced properties and/or which does not have the same composition as a known, conventional zinc alloy. For example, a ballistic zinc alloy may have a hardness of less than 60 BHN while remaining compatible with firearm use (e.g., frangible, ductile, and/or non-galling).

Ballistic zinc alloys are alloys of zinc (Zn), aluminum (Al), and at least one of magnesium (Mg), copper (Cu), iron (Fe), and nickel (Ni). For example, ballistic zinc alloys may comprise (by weight percent) at least 90% zinc and one or more of: at most 3.5% Al, at most 0.025% Mg, at most 0.075% Fe, at least 4.3% Al, at least 0.08% Mg, and at least 0.1% Fe. In some embodiments, e.g., ductile embodiments, a ballistic zinc alloy may comprise at most 3.5% Al, at most 0.025% Mg, and/or at most 0.075% Fe. In other embodiments, e.g., frangible embodiments, a ballistic zinc alloy may comprise at least 4.3% Al, at least 0.08% Mg, and/or at least 0.1% Fe.

DETAILED DESCRIPTION

Firearm projectiles produced according to the present disclosure include at least one component, or portion, that is formed at least substantially, if not completely, from a ballistic zinc alloy. As discussed in more detail herein, the ballistic zinc alloy contributes to the corresponding projectile having improved performance over firearm projectiles produced from zinc and conventional zinc alloys, such as Zamak alloys.

As used herein, the term "ballistic zinc alloy" refers to a zinc alloy that is disclosed herein and which has the enhanced properties disclosed and/or which does not have the same composition as a known, conventional zinc alloy. For example, the ballistic zinc alloy may include more or less of one or more constituent components of a known zinc alloy, may include at least one additional component that is not present in a similar known zinc alloy, and/or may not include a component that typically is present in a similar known zinc alloy. As discussed in more detail herein, while there are many known zinc alloys that have been used effectively for many years in a variety of applications and industries, known zinc alloys have not proven effective for use as firearm projectiles. Accordingly, the present disclosure is directed to ballistic zinc alloys that have different compositions and properties from these known zinc alloys, with the differences in composition and properties being selected, or designed, to improve the ballistic/performance property(ies) of firearm projectiles produced at least in part, if not substantially or completely, from the ballistic zinc alloys. A ballistic zinc alloy according to the present disclosure additionally or alternatively may be referred to herein as an improved zinc alloy, a zinc-aluminum alloy, a ductile zinc alloy, a frangible zinc alloy, an enhanced zinc alloy, a modified Zamak alloy, and/or simply as an alloy.

Figure 1:
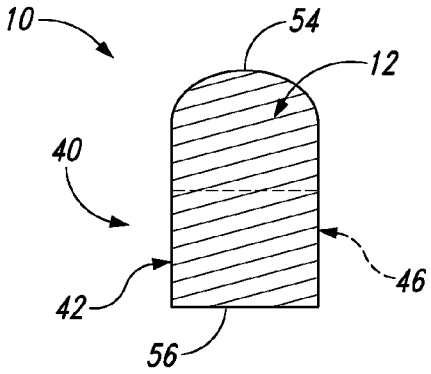
FIG. 1 is a schematic representation, in cross section, of a firearm projectile in the form of a bullet.

FIG. 1 schematically represents an article 10 that includes a ballistic zinc alloy 12. As represented in the figure, the article may be a firearm projectile 40 and may have any suitable shape, size, and/or configuration for use as a firearm projectile. For example, the projectile may take the form of a bullet 42, a slug, a pellet, shot, and/or a shot pellet 44 (as discussed further herein with reference to FIGS. 5-6). Firearm projectiles 40 may include a core 46 (also called a core portion and/or a central core) and/or additional components or structures, such as exterior coatings, surface coatings, lubricants, etc.

In some embodiments, only a portion, such as a nose portion 54 (also called a nose or a tip), of the firearm projectile 40 is formed from a ballistic zinc alloy 12. When only a portion of the firearm projectile is formed from a ballistic zinc alloy, this portion may be joined to one or more other portions, such as a shank portion 56 (also called a tail, a rear, or a heel portion), that are not formed from a ballistic zinc alloy. In FIG. 1, the distinction between two optional portions of the firearm projectile, the nose portion 54 and the shank portion 56, is schematically indicated with a dashed line. The portions of the firearm projectile may be joined by any suitable mechanism or material, for example with an adhesive, solder, sintering process, and/or a jacket. Portions of the firearm projectile that are not formed from a ballistic zinc alloy may be formed of conventional materials for firearm projectiles. For example, the shank portion may include steel and/or copper-clad steel.

Firearm projectiles 40 (optionally excluding any form of coating), cores 46, nose portions 54, and/or other portions may be at least substantially (at least 80 wt %), if not nearly completely (at least 90 wt %), or completely, formed from at least one ballistic zinc alloy. Other components of the firearm projectile and/or portion thereof may include binders, additives, other metals, other alloys, and/or other types of ballistic zinc alloy. Reference to being formed from ballistic zinc alloy may include being formed from a single disclosed ballistic zinc alloy and further may include being formed from two or more ballistic zinc alloys. When two or more ballistic zinc alloys are utilized, they may be themselves alloyed together to form a further/composite ballistic zinc alloy. Additionally or alternatively, the two or more ballistic zinc alloys may form separate regions or portions of the firearm projectile, such as layers or distinct/separate regions thereof. Furthermore, when a firearm projectile or component thereof is described as being formed from a ballistic zinc alloy, it does not require this portion to contain only the ballistic zinc alloy, although such a construction also is within the scope of the present disclosure.

Firearm projectiles 40, cores 46, nose portions 54, and/or other portions may be produced via any suitable process for manufacturing the same. Various illustrative, non-exclusive examples of formation processes are powder metallurgy, sintering, casting, forging, machining, and/or swaging. Forming the firearm projectile, and/or a portion thereof, from a ballistic zinc alloy 12 does not preclude the use of an exterior coating, a surface coating, a jacket, a lubricant, etc. It also does not preclude the inclusion of one or more additional components into the firearm projectile. For example, in powder metallurgy applications, particulate/powders formed from a ballistic zinc alloy may be mixed with particulate/powders with different compositions. In melt-and-cast applications, one or more additives may be added to the ballistic zinc alloy, provided that the additive is not itself a constituent component of the ballistic zinc alloy.

Figure 2:
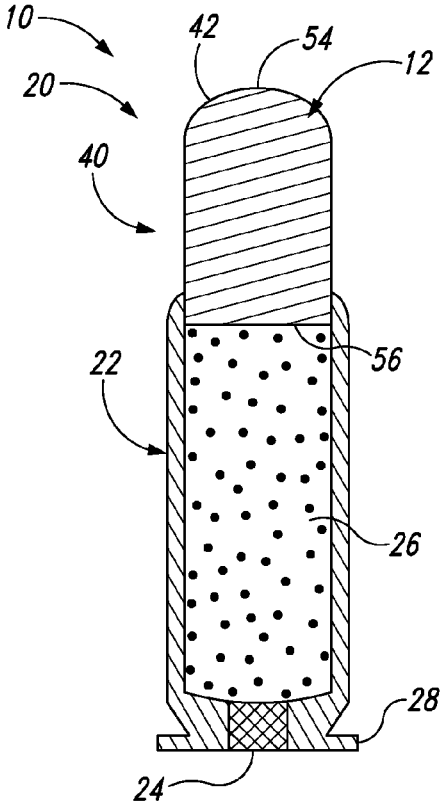
FIG. 2 is a schematic representation, in cross section, of a firearm cartridge that includes a firearm projectile in the form of a bullet.

As shown in FIG. 2, firearm projectiles 40 may be incorporated into firearm cartridges 20. FIG. 2 schematically illustrates a firearm cartridge 20 that contains a bullet 42. Accordingly, such a firearm cartridge may be referred to as a bullet cartridge. Firearm cartridges 20 comprise a firearm projectile 40 and a casing 22 (also called a case). The casing includes a base 28, a propellant 26 (also called a charge) and a primer 24 (also called a priming mixture). Casing 22, primer 24, and propellant 26 may be of any suitable materials, construction, and/or design as is known in the art of firearms. As shown in FIG. 2, firearm cartridge 40 is ready to be loaded into a gun, such as a handgun, rifle or the like, and upon firing, discharges bullet 42 at high speed and with a high rate of rotation. Although illustrated in FIG. 2 as a centerfire cartridge, in which the primer is located in the center of the base of the casing, bullets according to the present disclosure also may be incorporated into other types of firearm cartridges, such as a rimfire cartridge, in which the casing is rimmed or flanged and the primer is located inside the rim of the casing.

Figure 3:
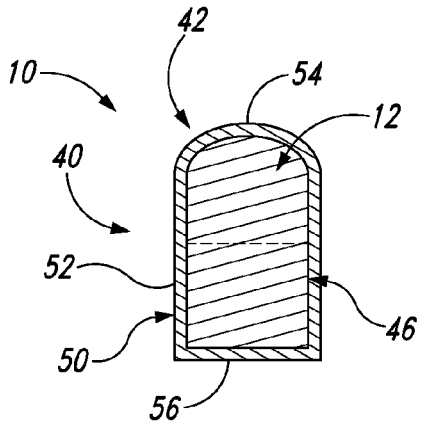
FIG. 3 is a schematic representation, in cross section, of a firearm projectile with a coating.

As schematically illustrated in FIG. 3, firearm projectiles 40 optionally may include a coating 50 (which may be an exterior coating and/or a surface coating), such as a jacket 52. In such an embodiment, firearm projectiles may be referred to as a coated, clad, and/or jacketed firearm projectile (e.g., a jacketed bullet). The coating and/or the jacket may at least substantially, if not completely, enclose a core 46 formed at least substantially from ballistic zinc alloy 12.

Figure 4:
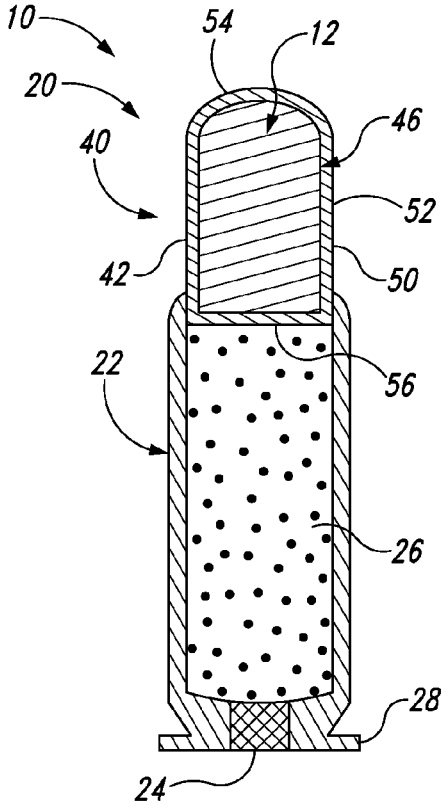
FIG. 4 is a schematic representation, in cross section, of a firearm cartridge that includes a firearm projectile with a coating.

In FIG. 4, a coated firearm projectile 40 is shown forming a component of a firearm cartridge 20. Because firearm projectiles, such as bullets, are commonly expelled from firearms at rotational speeds greater than 10,000 rpm, the firearm projectiles may encounter significant rotational forces. When the firearm projectile is formed from powders, there is a tendency for these rotational forces to remove portions of the firearm projectile during firing and flight. Jacket 52 may be used to prevent these rotational forces from fragmenting, obturing (deforming on account of fragmenting and centrifugal forces), and/or dispersing the core during flight.

When present, jacket 52 may partially or completely enclose the core 46. Where the jacket only partially encloses the core, a portion of the core is not covered by the jacket. For example, the nose portion 54 of the core may be unjacketed. Jacket 52 may have a variety of thicknesses. Typically, jacket 52 will have an average thickness of less than 1 mm, less than 0.7 mm, less than 0.5 mm, and/or less than 0.3 mm. Accordingly, the depicted thickness of the jacket and relative thickness of the jacket compared to the overall shape and size of the firearm projectile in FIGS. 3-4 have been exaggerated for the purpose of illustration.

Some firearms, such as handguns and rifles, have barrels with rifling that projects internally into the barrels to impart axial rotation to the firearm projectile 40 as the firearm projectile travels along the barrel. Accordingly, a jacketed firearm projectile may have a jacket thickness that exceeds the height of the rifling. Otherwise, it might be possible for the rifling to cut through the jacket 52 and thereby expose the core 46. This, in turn, may affect the flight and performance of the firearm projectile, as well as increase fouling of the barrel. A jacket thickness that is at least 0.02 mm, at least 0.03 mm, at least 0.04 mm, at least 0.05 mm, at least 0.07 mm, at least 0.1 mm, and/or 0.05-0.1 mm thicker than the height of the rifling lands has proven effective. For most applications, a jacket 52 that is at least 0.1 mm thick should be sufficient. In firearms, such as shotguns, that have barrels with smooth (non-rifled) internal bores, a thinner jacket may be used, such as a jacket that is 0.02-0.05 mm thick. However, it is not required in these applications for the jacket to be thinner, and thicker jackets may be used as well.

An illustrative, non-exclusive example of a suitable material for jacket 52 is copper, although other materials may be used. Additionally or alternatively, jacket 52 may be formed from one or more other metallic materials, such as alloys of copper (like brass and/or gilding metal), a ferrous metal alloy, and/or aluminum. In some embodiments, jacket 52 may be formed from gilding metal (95 wt % copper and 5 wt % zinc), for example, when the firearm projectiles are designed to be higher velocity firearm projectiles, such as firearm projectiles that are designed to travel at speeds of at least 600 m/s, 750 m/s, or greater than 750 m/s (2,000, 2,500, or more feet per second). Jacket 52 may also be formed from a non-metal material, such as a polymer or a plastic. An example of such a material is nylon.

When jacket 52 is formed from powdered metallic materials, the firearm projectile 40 may be formed by compressing the powder and the binder in the jacket. Alternatively, the core 46 of the firearm projectile may be formed and thereafter placed within a jacket 52. As another example, the core may be formed and then the jacket may be applied over the core by electroplating, vapor deposition, spray coating or other suitable application methods. For non-metallic jackets, dip coating, spray coating, and similar application methods have proven effective.

Figure 5:
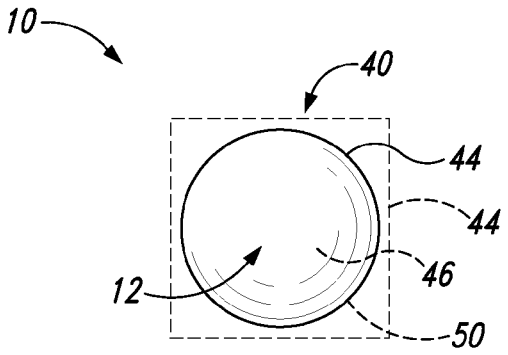
FIG. 5 is a schematic representation of a firearm projectile in the form of a shot pellet.

FIG. 5 schematically represents another type of firearm projectile 40, namely a shot pellet 44 that is at least partially formed from ballistic zinc alloy 12. As represented in solid line, shot pellet 44 has a spherical configuration. However, shot pellet 44 may have a variety of regular and irregular configurations, with the dashed-line shot pellet 44 of the figure schematically representing this range of sizes and/or shapes. As illustrative, non-exclusive examples, shot pellets 44 that are formed by casting a molten mass of ballistic zinc alloy or via powder metallurgy tend to have more regular configurations, while shot pellets 44 that are formed by pouring or otherwise dropping a molten mass of ballistic zinc alloy into a quenching liquid tend to have more irregular shapes.

Figure 6:
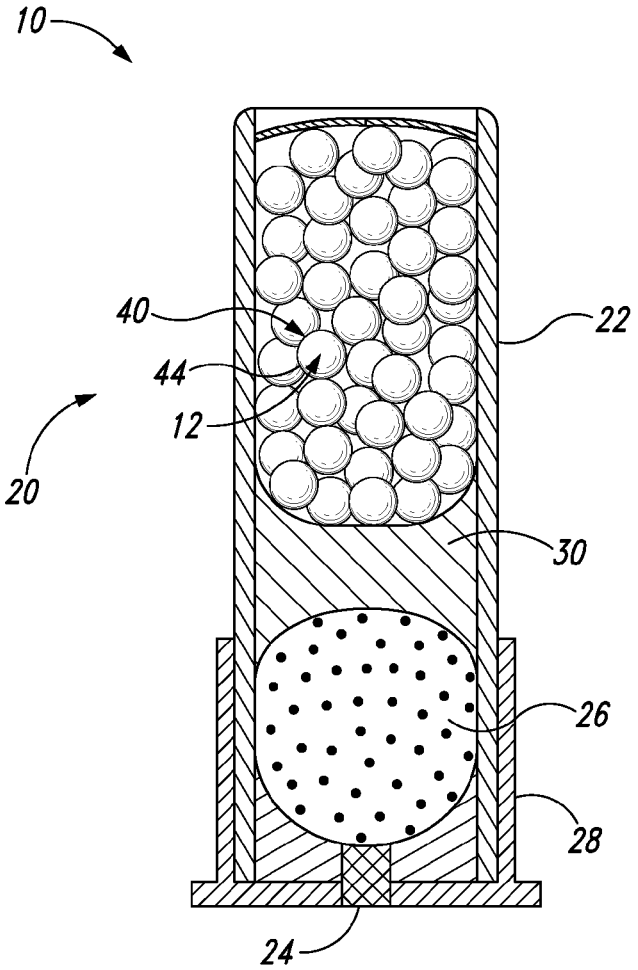
FIG. 6 is a schematic representation, in cross section, of a firearm cartridge in the form of a shot shell that includes a plurality of firearm projectiles in the form of shot pellets.

As shown in FIG. 6, shot pellets 44 may be a constituent element of a firearm cartridge 20. In such a case, the firearm cartridge may be called a shotgun cartridge, or a shot shell. As shown, firearm cartridge 20 is ready to be loaded into a firearm, such as a shotgun, and upon firing, discharge shot pellets 44 at high speeds. A plurality of shot pellets 44 may be loaded into a firearm cartridge 20, with the number of individual shot pellets 44 contained in the firearm cartridge varying from approximately 5-10 shot pellets to dozens or hundreds of shot pellets, such as depending upon the dimensions of the shot pellets and/or the intended application for the firearm cartridge.

As shown in FIG. 6, firearm cartridges 20 configured for shot pellets 44 include a case 22 with a base 28. The base 28 typically is formed from metal and houses a wad 30, a propellant 26, and a primer 24. Firearm cartridges 20 configured for shot pellets 44 may include other constituent elements, as are conventional or otherwise known in the field of shotgun cartridge construction.

Illustrative examples of firearm projectiles, firearm cartridges that include the same, and optional components thereof are disclosed in U.S. Pat. Nos. 8,171,849, 7,267,794, 7,059,233, and 7,000,547, U.S. Patent Application Publication Nos. 2013/0145951, and U.S. Provisional Patent Application Ser. No. 61/841,075, the disclosures of which are hereby incorporated by reference for all purposes.

A firearm projectile 40 formed from a ballistic zinc alloy 12 according to the present disclosure may be sufficiently brittle to be effective, such as for frangible firearm projectiles, while also being sufficiently strong and/or ductile to retain the projectile's integrity while traveling through the barrel of a firearm during firing of a firearm cartridge containing the projectile. Additionally or alternatively, a firearm projectile formed from a ballistic zinc alloy according to the present disclosure may be sufficiently ductile to expand, deform, or "mushroom," upon impact with an animal or other soft target. Further additionally, or alternatively, a firearm projectile formed from a ballistic zinc alloy according to the present disclosure may (1) exhibit reduced, if not no, sparking, such as when fired against a steel plate at close range, e.g., less than 25 yards (about 23 m), and/or (2) be produced without requiring mechanical sizing to have a desired shape and/or size for use in a firearm cartridge. Similarly, while annealing or heat-treating optionally may be performed on a firearm projectile produced with a ballistic zinc alloy according to the present disclosure, such as to increase the ductility of and/or to artificially age (for shrinkage) the firearm projectile, it is not required.

Consideration of conventional Zamak alloys and their properties, such as presented herein, reveals that these alloys generally include approximately 3.5-4.3 wt % aluminum and approximately 1-3 wt % (combined) of copper, magnesium, iron, and nickel, as well as measurable amounts of impurities, such as lead, cadmium, and tin.

Experiments and research have demonstrated that none of these conventional Zamak alloys are ideal for forming firearm projectiles. For example, most are far too brittle and/or not sufficiently ductile for effective use as an expanding/mushrooming or frangible firearm projectile. For example, none of the conventional Zamak alloys have proven to be sufficiently frangible to meet FLETC standards for frangible bullets. Of the Zamak alloys, Zamak-7 is perhaps the closest to being suitable for use as a firearm projectile, but it still does not result in a firearm projectile with acceptable performance.

As the name implies, a ballistic zinc alloy according to the present disclosure will include zinc as its primary component, such as with zinc constituting at least 75 wt %, at least 80 wt %, at least 85 wt %, at least 90 wt %, at least 93 wt %, at least 95 wt %, at least 96%, at least 97 wt %, 70-95 wt %, 80-97 wt %, 90-95 wt %, 90-96 wt %, 90-98 wt %, 95-98 wt %, less than 98 wt %, less than 97 wt %, less than 96 wt %, less than 95 wt %, less than 94 wt %, and/or less than 93 wt % zinc.

Many ballistic zinc alloys according to the present disclosure also will include aluminum. For example, a ballistic zinc alloy may include at least 2.0 wt %, at least 2.25 wt %, at least 2.4 wt %, at least 2.5 wt %, at least 2.6 wt %, at least 3.0 wt %, at least 3.5 wt %, at least 4.0 wt %, at least 4.3 wt %, more than 4.3 wt %, at least 4.4 wt %, at least 4.5 wt %, at least 4.6 wt %, at least 4.7 wt %, at least 4.8 wt %, at least 4.9 wt %, at least 5.0 wt %, more than 5.03 wt %, at least 5.04 wt %, at least 5.1 wt %, at least 5.5 wt %, at least 6.0 wt %, 2-3.4 wt %, 2-3.8 wt %, 2-4 wt %, 2.2-3.4 wt %, 2.3-3.8 wt %, 2.45-2.75 wt %, 2.5-6.5 wt %, 2.5-5 wt %, 3-5 wt %, 3-3.4 wt %, 4-5 wt %, 4.4-5.1 wt %, 4.4-5.2 wt %, 4.4-5.5 wt %, 4.4-6 wt %, 4.5-5.1 wt %, 4.6-5.0 wt %, 4.65-4.95 wt %, 5-5.1 wt %, 5.1-6.5 wt %, 5.5-6.5 wt %, less than 6.5 wt %, less than 6.0 wt %, less than 5.5 wt %, less than 5.3 wt %, less than 5.1 wt %, less than 5.03 wt %, less than 5.0 wt %, less than 4.9 wt %, less than 4.7 wt %, less than 4.5 wt %, less than 4.2 wt %, less than 4.1 wt %, less than 4.0 wt %, less than 3.9 wt %, less than 3.8 wt %, less than 3.7 wt %, less than 3.6 wt %, less than 3.5 wt %, less than 3.4 wt %, less than 3.0 wt %, and/or less than 2.5 wt % aluminum, and/or not 3.5-4.3 wt % aluminum. Zinc and aluminum may form at least 85 wt %, at least 90 wt %, at least 95 wt %, at least 96 wt %, at least 97 wt %, at least 98 wt %, at least 99 wt %, at least 99.5 wt %, 85-99 wt %, 90-99 wt %, 95-99 wt %, less than 99.9 wt %, less than 99.5 wt %, less than 99 wt %, less than 98 wt %, less than 97 wt %, less than 96 wt % and/or less than 95 wt % of a ballistic zinc alloy according to the present disclosure.

A ballistic zinc alloy 12 according to the present disclosure also may include, or specifically not include, one or more additional components. As illustrative examples, a ballistic zinc alloy may include one, two, three, or all four of magnesium, copper, iron, and nickel. When present, this/these component(s) may be present in the alloy individually and/or collectively, in concentrations of less than 3 wt %, less than 2 wt %, less than 1.75 wt %, less than 1.5 wt %, less than 1 wt %, less than 0.75 wt %, less than 0.5 wt %, less than 0.25 wt %, less than 0.2 wt %, less than 0.1 wt %, less than 0.05 wt %, less than 0.025 wt %, less than 0.01 wt %, less than 0.005 wt %, 3-0.2 wt %, 2-0.25 wt %, 1.5-0.5 wt %, 1-0.25 wt %, 0.25-0.05 wt %, 0.02-0.005 wt %, at least 0.1 wt %, at least 0.15 wt %, at least 0.25 wt %, at least 0.4 wt %, and/or at least 0.5 wt %.

When present, magnesium may increase corrosion resistance of the ballistic zinc alloy and firearm projectiles formed therefrom. In this regard, magnesium may mitigate and/or prevent some of the decreased corrosion resistance that otherwise may result if the alloy contains lead, cadmium, and/or tin. Including magnesium in a ballistic zinc alloy may provide a degree of buffer, or guard, against unintended concentrations of lead, cadmium, and/or tin.

When present, copper may increase the strength of the ballistic zinc alloy and firearm projectiles formed therefrom. However, the inclusion of copper in the ballistic zinc alloy may increase the likelihood of the alloy shrinking slightly over time, especially in the initial weeks after formation of a firearm projectile from the alloy. Thus, when copper is included in the ballistic zinc alloy, the resulting alloy and/or projectiles formed therefrom may be annealed or otherwise heat-treated to accelerate this shrinkage, such as prior to incorporation of the projectile into a firearm cartridge.

When present, iron may promote frangibility of the ballistic zinc alloy and firearm projectiles formed therefrom.

When present, nickel may increase corrosion resistance of the ballistic zinc alloy and firearm projectiles formed therefrom. In this regard, nickel may mitigate and/or prevent some of the decreased corrosion resistance that otherwise may result if the alloy contains lead, cadmium, and/or tin. Including nickel in a ballistic zinc alloy may provide a degree of buffer, or guard, against unintended concentrations of lead, cadmium, and/or tin.

Impurities may be any component other than the intentionally alloyed components of the ballistic zinc alloy and may include, for example, trace amounts of lead, cadmium, tin, antimony, silicon, etc. In some embodiments, components such as copper, magnesium, iron, and/or nickel may be impurities.

In some embodiments, a ballistic zinc alloy 12 may not include (i.e., be free of, or essentially free of) lead, cadmium, tin, and/or other impurities. In such embodiments, ballistic zinc alloys generally are considered nontoxic, or at least substantially less toxic than firearm projectiles that include lead and/or cadmium. For example, a ballistic zinc alloy may include less than 0.1 wt %, less than 0.05 wt %, less than 0.01 wt %, less than 0.005 wt %, less than 0.003 wt %, less than 0.002 wt %, less than 0.001 wt %, 0.1-0.001 wt %, 0.01-0.005 wt %, 0.005-0.001 wt %, at least 0.0005 wt %, at least 0.001 wt %, and/or at least 0.003 wt % (individually and/or collectively) of one, two, or all of lead, cadmium, and/or tin.

When preparing firearm projectiles 40 from a ballistic zinc alloy 12 according to the present disclosure, the selected composition of the alloy and/or design of the projectile may include consideration of whether the projectile is intended to be primarily a frangible projectile, such as for use at indoor/enclosed shooting ranges, or primarily a ductile projectile, such as used for hunting. For example, ductile projectiles may be desired for big-game hunting, varmint hunting, and/or outdoor target shooting, and frangible projectiles may be desired for indoor target shooting, outdoor target shooting, and/or varmint hunting.

As discussed, when forming a ductile firearm projectile (e.g., a ductile bullet), at least the nose portion (as shown in FIGS. 1-4) ideally should expand, deform, or "mushroom," when the projectile strikes an animal or other target. Although other ranges and criteria may be adopted, ductile ballistic zinc alloy projectiles may expand in diameter by at least 10%, at least 25%, at least 50%, at least 75%, and/or at least 100%, when fired at normal (conventional) velocities and distances and when striking a "soft" target, such as an animal or ordnance gelatin.

While it may be desirable that at least the nose portions of expanding/mushrooming bullets be as ductile as possible, portions of bullets that are full diameter for the selected caliber also should be strong enough to effectively engage gun barrel rifling "lands" and "grooves" without failing in shear by smearing or crumbling. As a reference point for suitable properties, typical mechanical properties of the most commonly used bullet (and/or bullet jacket) material, gilding metal (95 wt % Cu and 5 wt % Zn), and also of the second most popular material, pure copper, are summarized in Table III. Both gilding metal and copper are utilized in bullets in a variety of cold-worked conditions (from "dead-soft annealed" to "full hard"). "Half hard" values also are summarized in Table III.

TABLE III

Mechanical Properties of Copper Alloys

| | Gilding Metal | Copper | Gilding Metal, "half hard" | Copper, "half hard" |
|---|---|---|---|---|
| Ultimate Tensile Strength, MPa | 234-441 | 221-393 | 330 | 290 |
| Yield Strength, MPa | 69-400 | 76-366 | 276 | 248 |
| % Elongation | 4-45 | 4-45 | 12 | 14 |
| Shear Strength, MPa | 193-276 | 159-200 | 234 | 179 |
| Hardness, BHN | 10-45.5 | 10-40.5 | 36 | 30.8 |

Some ballistic zinc alloys 12 according to the present disclosure may have properties that approximate the indicated "half hard" values of the conventional copper alloys, while recognizing that ductile firearm projectile types may especially benefit from maximizing ductility (e.g., maximizing the "% Elongation").

Of the conventional zinc die-casting alloys, only Zamak-7 (as detailed in Table II) has strength and ductility values that are somewhat similar to the corresponding strength and ductility values of these illustrative copper alloys. However, Zamak-7 also has a hardness of about 80 BHN, considerably higher than these copper alloys. Therefore, some ballistic zinc alloys according to the present disclosure have compositions that are similar to Zamak-7, but which have reduced hardness, optionally a hardness that is less than 60 BHN, less than 50 BHN, less than 40 BHN, less than 30 BHN, at least 10 BHN, at least 20 BHN, at least 30 BHN, and/or at least 40 BHN. Accordingly, a ballistic zinc alloy may have an ultimate tensile strength of 200-420 MPa, 240-380 MPa, 270-350 MPa, at least 200 MPa, at least 240 MPa, at least 270 MPa, at least 310 MPa, at least 340 MPa, less than 420 MPa, less than 350 MPa, less than 310 MPa, and/or less than 280 MPa; a ductility (% elongation) of 4-30%, 5-30%, 7.5-20%, 10-25%, 6-40%, 8-30%, 12-30%, 10-20%, at least 5%, at least 10%, at least 12%, at least 15%, at least 20%, at least 25%, at least 30%, less than 40%, less than 30%, less than 25%, less than 20%, and/or less than 15%; a yield strength of 200-420 MPa, 240-380 MPa, 270-350 MPa, at least 70 MPa, at least 200 MPa, at least 240 MPa, at least 270 MPa, at least 310 MPa, at least 340 MPa, less than 420 MPa, less than 350 MPa, less than 310 MPa, less than 280 MPa, and/or less than 200 MPa; and/or a shear strength of at least 160 MPa, at least 180 MPa, at least 200 MPa, less than 280 MPa, less than 220 MPa, less than 200 MPa, and/or less than 180 MPa.

Adjusting, or enhancing, the properties of a conventional zinc alloy may be accomplished in a variety of ways, with the scope of the present disclosure not being limited to the examples that are described herein, as the ballistic zinc alloy compositions that are disclosed herein, as well as firearm projectiles that are formed (entirely or in part) from the same, also are considered to be inventive and within the scope of the present disclosure regardless of the specific method that is utilized to produce the alloys and/or projectiles.

For some ductile ballistic zinc alloys, the concentration of aluminum in the alloy may be less than 4.1 wt %, less than 4.0 wt %, less than 3.9 wt %, less than 3.8 wt %, less than 3.7 wt %, less than 3.6 wt %, less than 3.5 wt %, less than 3.4 wt %, less than 3 wt %, less than 2.5 wt %, 2-4 wt %, 2-3.8 wt %, 2-3.4 wt %, 2.2-3.4 wt %, 2.3-2.8 wt %, 2.45-2.75 wt %, at least 2 wt %, at least 2.25 wt %, at least 2.4 wt %, and/or at least 2.6 wt %.

For example, a ductile ballistic zinc alloy may have the following composition: Al: 4.0 wt %, max.; Mg: 0.015 wt %, max.; Cu: 0.20 wt %, max.; Pb: 0.003 wt %, max.; Cd: 0.002 wt %, max.; Sn: 0.001 wt %, max.; Fe: 0.05 wt %, max.; Ni: 0.005-0.15 wt %; balance Zn and incidental impurities. Hollow-point 0.30 caliber (0.308-in.-dia.) rifle bullets cast with this approximate composition display ductile "mushrooming" deformation when shot at about 750 m/s into ordnance gelatin, and are properly engraved with distinctive rifling marks. As another example, a ductile ballistic zinc alloy may have the following composition: Al: 2.45-2.75 wt %; Mg: 0.005-0.02 wt %; Cu: 0.25 wt %, max; Pb: 0.003 wt %, max; Cd: 0.002 wt %, max; Sn: 0.001 wt %, max; Fe: 0.075 wt %, max; Ni: 0-0.15 wt %; balance Zn and incidental impurities. Another example is a Zamak-7 alloy to which sufficient additional components have been added to reduce the alloy's hardness to within 30%, within 20%, within 10%, within 5%, or within 1% of the hardness of copper or copper alloys that conventionally are used in firearm projectiles, such as the alloys presented in Table III. For example, adding zinc to a Zamak-7 composition may dilute the aluminum, iron, and/or magnesium concentrations and result in a ballistic zinc alloy that is more ductile than Zamak-7.

When forming a frangible firearm projectile from a ballistic zinc alloy 12, it is more likely, but not required, that the entire projectile 40 will be formed from the alloy (or potentially, the alloy with a surface coating of a different material). Although not required for all frangible firearm projectiles formed from ballistic zinc alloys, the frangible firearm projectiles may be sufficiently strong to remain intact during firing of a corresponding cartridge and travel along the barrel of a corresponding firearm, while also breaking up into particulate that is within maximum and/or minimum particle size values. For example, U.S. Federal Law Enforcement Training Center (FLETC) guidelines recommend that particle sizes from frangible bullets be no greater than 5 grains (0.324 grams). As another example, Table IV lists examples of maximum dust concentrations according to the U.S. Occupational Safety & Health Administration (OSHA) Permissible Exposure Limit (PEL) standards.

TABLE IV

| Permissible Exposure Limits (PEL) maximum dust concentrations in air (mg/m$^3$, time-weighted average for an 8-hr shift) | | | | | | |
|---|---|---|---|---|---|---|
| Zn | Al | Mg | Cu | Pb | Cd | Sn |
| 15 | 15 | no limit | 0.1 | 0.05 | 0.0025 | 2 |

A binary alloy of zinc and aluminum has a eutectic point at 5.03 wt % aluminum. Thus, a zinc-aluminum alloy with 5.03 wt % aluminum should be the most brittle zinc-aluminum binary alloy. It follows then that zinc-aluminum alloys having a greater or lesser amount of aluminum should be less brittle and/or more ductile than an alloy containing this eutectic composition.

From the preceding Table I, it can be seen that Zamak alloys have "hypoeutectic" compositions (alloys with less aluminum than the eutectic point), in which the concentration of aluminum does not exceed 4.3 wt %. However, the brittleness of zinc-aluminum alloys changes significantly with changes in the aluminum concentration, especially as the aluminum concentration nears, or even exceeds, the eutectic concentration. For example, a zinc-aluminum binary alloy containing 4.5 wt % aluminum generally is regarded as being "measurably" brittle, whereas a zinc-aluminum alloy containing 5 wt % aluminum is considered to be "completely brittle."

Accordingly, a frangible ballistic zinc alloy according to the present disclosure may include a greater concentration of aluminum and/or a lower concentration of zinc, than is present in conventional Zamak alloys. For example, a frangible ballistic zinc alloy may contain at least 4.5 wt %, at least 4.6 wt %, at least 4.7 wt %, at least 4.8 wt %, at least 4.9 wt %, more than 5.03 wt %, at least 5.1 wt %, 4.4-5.5 wt %, 4.4-5.2 wt %, 4.5-5.1 wt %, 4.6-5.0 wt %, 4.65-4.95 wt %, 5-5.1 wt %, less than 5.5 wt %, less than 5.3 wt %, less than 5.1 wt %, less than 5.0 wt %, less than 4.9 wt %, less than 4.7 wt %, and/or less than 4.5 wt % aluminum.

Another example of a frangible ballistic zinc alloy according to the present disclosure is Zamak-3 to which sufficient iron, magnesium, and/or other hardness-increasing component is added to produce the desired frangibility, and optionally such an alloy in which the concentration of copper has been reduced by at least 50%, at least 75%, at least 85%, at least 95%, or 100%. As further examples, a frangible ballistic zinc alloy may include modifying the Zamak-3 alloy and/or one of the ballistic zinc alloys disclosed herein to include (1) at least 0.12 wt %, at least 0.15 wt %, at least 0.2 wt %, at least 0.3 wt %, at least 0.5 wt %, 0.11-0.5 wt %, and/or 0.12-0.5 wt % iron, and/or (2) at least 0.001 wt %, at least 0.002 wt %, at least 0.003 wt %, at least 0.005 wt %, at least 0.01 wt %, at least 0.02 wt %, 0.001-0.02 wt %, 0.005-0.01 wt %, less than 0.1 wt %, and/or less than 0.05 wt % nickel.

As a further example, a frangible ballistic zinc alloy may have the following composition: Al: 4.65-4.95 wt %; Mg: 0.025-0.05 wt %; Cu: 0.25 wt %, max; Pb: 0.005 wt %, max; Cd: 0.004 wt %, max; Sn: 0.003 wt %, max; Fe: 0.1 wt %, max; balance Zn. As another example, a frangible ballistic zinc alloy may have the following composition: Al: 3.9-5.1 wt %; Mg: 0.050 wt %, min.; Fe: 0.12 wt %, min.; Pb: 0.005 wt %, max.; Cd: 0.004 wt %, max.; Sn: 0.003 wt %, max.; balance Zn and incidental impurities.

Bullets made with frangible ballistic zinc alloys according to the present disclosure, in experimental testing, have not only exhibited markedly improved frangibility over bullets formed from conventional zinc alloys, but also result in particle sizes that satisfy OSHA's PEL standard and the FLETC guideline for indoor firing ranges.

It is believed that firearm projectiles formed from ballistic zinc alloys according to the present disclosure may be cast or otherwise formed within acceptable size tolerances, such as with a diameter tolerance of ±0.02 mm without requiring post-formation (i.e., post-compaction or post-casting) mechanical grinding, abrasion, or other sizing steps. However, post-formation annealing, heat-treating, or other sizing steps may be utilized without departing from the scope of the present disclosure. Post-formation annealing and/or other heat-treating may increase the ductility of some ballistic zinc alloys and/or firearm projectiles formed therefrom. For example, utilizing such a process step may further improve the dimensional stability of firearm projectiles formed from a ballistic zinc alloy, such as to "match-grade" bullets that require tolerances of ±0.01 mm. Heating the projectiles at a temperature of 90° C.-120° C., such as 100° C., for at least 2 hours, such as 3-6 hours, has proven effective, although other temperatures and durations may be utilized.

Finally, it should be noted that firearm projectile deformation behavior, as it relates to the various degrees of firearm projectile "frangibility," ranging from "powdering" upon impact to ductile "mushrooming," is not solely dependent upon the firearm projectile's and/or ballistic zinc alloy's material properties. For example, bullet and cartridge design criteria may play a role in the terminal ballistic behavior of any given projectile that strikes a particular type of target. Firearm projectile and/or firearm cartridge designs can be manipulated to either encourage or discourage terminal performance, including frangibility, degree of "mushrooming," weight retention, sparking, etc. Die-casting and other tooling designs may advantageously feature optimum placement of "parting lines," "gating" points, etc. in order to optimize firearm projectile rotational symmetry, spin stabilization, etc.

Another factor to consider is the ability of a firearm projectile's exterior (perimeter) surfaces to properly engage a gun barrel's rifling "lands" and "grooves" such that stabilizing spin is imparted to the firearm projectile as it is propelled along the length of the barrel. The traditional materials used to fulfill this requirement, especially in lead-based pistol and rifle bullets, include gilding metal (95 wt % Cu and 5 wt % Zn) and pure copper. Common Zamak and similar known zinc alloys offer little potential for performing this function, especially at relatively high velocities (e.g., greater than approximately 600 m/s), due to insufficient ductility. Instead, engagement with the rifling tends to cause conventional zinc-alloy bullets to crumble or "smear" (gall or otherwise impart metal on the inside of the barrel).

Illustrative, non-exclusive examples of inventive subject matter according to the present disclosure are described in the following enumerated paragraphs.

A1. A zinc alloy, comprising:

aluminum;

a combination of at least one of magnesium, copper, iron, and nickel; and the balance being zinc and incidental impurities.

A2. The zinc alloy of paragraph A1, wherein aluminum is at a concentration of at least 2.0 wt %, at least 2.25 wt %, at least 2.4 wt %, at least 2.5 wt %, at least 2.6 wt %, at least 3.0 wt %, at least 3.5 wt %, at least 4.0 wt %, at least 4.3 wt %, more than 4.3 wt %, at least 4.4 wt %, at least 4.5 wt %, at least 4.6 wt %, at least 4.7 wt %, at least 4.8 wt %, at least 4.9 wt %, at least 5.0 wt %, more than 5.03 wt %, at least 5.04 wt %, at least 5.1 wt %, at least 5.5 wt %, at least 6.0 wt %, 2-3.4 wt %, 2-3.8 wt %, 2-4 wt %, 2.2-3.4 wt %, 2.3-3.8 wt %, 2.45-2.75 wt %, 2.5-6.5 wt %, 2.5-5 wt %, 3-5 wt %, 3-3.4 wt %, 4-5 wt %, 4.4-5.1 wt %, 4.4-5.2 wt %, 4.4-5.5 wt %, 4.4-6 wt %, 4.5-5.1 wt %, 4.6-5.0 wt %, 4.65-4.95 wt %, 5-5.1 wt %, 5.1-6.5 wt %, 5.5-6.5 wt %, less than 6.5 wt %, less than 6.0 wt %, less than 5.5 wt %, less than 5.3 wt %, less than 5.1 wt %, less than 5.03 wt %, less than 5.0 wt %, less than 4.9 wt %, less than 4.7 wt %, less than 4.5 wt %, less than 4.2 wt %, less than 4.1 wt %, less than 4.0 wt %, less than 3.9 wt %, less than 3.8 wt %, less than 3.7 wt %, less than 3.6 wt %, less than 3.5 wt %, less than 3.4 wt %, less than 3.0 wt %, and/or less than 2.5 wt %.

A3. The zinc alloy of any of paragraphs A1-A2, wherein zinc is at a concentration of at least 75 wt %, at least 80 wt %, at least 85 wt %, at least 90 wt %, at least 93 wt %, at least 95 wt %, at least 96%, at least 97 wt %, 70-95 wt %, 80-97 wt %, 90-95 wt %, 90-96 wt %, 90-98 wt %, 95-98 wt %, less than 98 wt %, less than 97 wt %, less than 96 wt %, less than 95 wt %, less than 94 wt %, and/or less than 93 wt %.

A4. The zinc alloy of any of paragraphs A1-A3, wherein zinc and aluminum are at a combined concentration of at least 85 wt %, at least 90 wt %, at least 95 wt %, at least 96 wt %, at least 97 wt %, at least 98 wt %, at least 99 wt %, at least 99.5 wt %, 85-99 wt %, 90-99 wt %, 95-99 wt %, less than 99.9 wt %, less than 99.5 wt %, less than 99 wt %, less than 98 wt %, less than 97 wt %, less than 96 wt % and/or less than 95 wt %.

A5. The zinc alloy of any of paragraphs A1-A4, wherein the combination includes at least two of magnesium, copper, iron, and nickel, optionally wherein the combination includes at least three of magnesium, copper, iron, and nickel, and further optionally wherein the combination includes all of magnesium, copper, iron, and nickel.

A5.1 The zinc alloy of any of paragraphs A1-A5, wherein the combination is at a concentration of less than 3 wt %, less than 2 wt %, less than 1.75 wt %, less than 1.5 wt %, less than 1 wt %, less than 0.75 wt %, less than 0.5 wt %, less than 0.25 wt %, less than 0.2 wt %, less than 0.1 wt %, less than 0.05 wt %, less than 0.025 wt %, less than 0.01 wt %, less than 0.005 wt %, 3-0.2 wt %, 2-0.25 wt %, 1.5-0.5 wt %, 1-0.25 wt %, 0.25-0.05 wt %, 0.02-0.005 wt %, at least 0.1 wt %, at least 0.15 wt %, at least 0.25 wt %, at least 0.4 wt %, and/or at least 0.5 wt %.

A6. The zinc alloy of any of paragraphs A1-A5.1, wherein the combination includes magnesium and wherein magnesium is at a concentration of less than 3 wt %, less than 2 wt %, less than 1.75 wt %, less than 1.5 wt %, less than 1 wt %, less than 0.75 wt %, less than 0.5 wt %, less than 0.25 wt %, less than 0.2 wt %, less than 0.1 wt %, less than 0.05 wt %, less than 0.025 wt %, less than 0.02 wt %, less than 0.01 wt %, less than 0.005 wt %, 3-0.2 wt %, 2-0.25 wt %, 1.5-0.5 wt %, 1-0.25 wt %, 0.25-0.05 wt %, 0.02-0.005 wt %, at least 0.005 wt %, at least 0.02 wt %, at least 0.05%, at least 0.08%, at least 0.1 wt %, at least 0.15 wt %, at least 0.25 wt %, at least 0.4 wt %, and/or at least 0.5 wt %.

A7. The zinc alloy of any of paragraphs A1-A6, wherein the combination includes copper and copper is at a concentration of less than 3 wt %, less than 2 wt %, less than 1.75 wt %, less than 1.5 wt %, less than 1 wt %, less than 0.75 wt %, less than 0.5 wt %, less than 0.25 wt %, less than 0.2 wt %, less than 0.1 wt %, less than 0.05 wt %, less than 0.025 wt %, less than 0.01 wt %, less than 0.005 wt %, 3-0.2 wt %, 2-0.25 wt %, 1.5-0.5 wt %, 1-0.25 wt %, 0.25-0.05 wt %, 0.02-0.005 wt %, at least 0.1 wt %, at least 0.15 wt %, at least 0.25 wt %, at least 0.4 wt %, and/or at least 0.5 wt %.

A8. The zinc alloy of any of paragraphs A1-A7, wherein the combination includes iron and iron is at a concentration of less than 3 wt %, less than 2 wt %, less than 1.75 wt %, less than 1.5 wt %, less than 1 wt %, less than 0.75 wt %, less than 0.5 wt %, less than 0.25 wt %, less than 0.2 wt %, less than 0.1 wt %, less than 0.05 wt %, less than 0.025 wt %, less than 0.01 wt %, less than 0.005 wt %, 3-0.2 wt %, 2-0.25 wt %, 1.5-0.5 wt %, 1-0.25 wt %, 0.5-0.11 wt %, 0.5-0.12 wt %, 0.25-0.05 wt %, 0.02-0.005 wt %, at least 0.05 wt %, at least 0.1 wt %, at least 0.12 wt %, at least 0.15 wt %, at least 0.2 wt %, at least 0.25 wt %, at least 0.3 wt %, at least 0.4 wt %, and/or at least 0.5 wt %.

A9. The zinc alloy of any of paragraphs A1-A8, wherein the combination includes nickel and nickel is at a concentration of less than 3 wt %, less than 2 wt %, less than 1.75 wt %, less than 1.5 wt %, less than 1 wt %, less than 0.75 wt %, less than 0.5 wt %, less than 0.25 wt %, less than 0.2 wt %, less than 0.1 wt %, less than 0.05 wt %, less than 0.025 wt %, less than 0.01 wt %, less than 0.005 wt %, 3-0.2 wt %, 2-0.25 wt %, 1.5-0.5 wt %, 1-0.25 wt %, 0.25-0.05 wt %, 0.02-0.005 wt %, 0.02-0.001 wt %, 0.01-0.005 wt %, at least 0.001 wt %, at least 0.002 wt %, at least 0.003 wt %, at least 0.005 wt %, at least 0.01 wt %, at least 0.02 wt %, at least 0.1 wt %, at least 0.15 wt %, at least 0.25 wt %, at least 0.4 wt %, and/or at least 0.5 wt %.

A10. The zinc alloy of any of paragraphs A1-A9, further comprising an impurity combination of at least one of lead, cadmium, and tin.

A10.1. The zinc alloy of paragraph A10, wherein the impurity combination is at a concentration of less than 0.1 wt %, less than 0.05 wt %, less than 0.01 wt %, less than 0.005 wt %, less than 0.003 wt %, less than 0.002 wt %, less than 0.001 wt %, 0.1-0.001 wt %, 0.01-0.005 wt %, 0.005-0.001 wt %, at least 0.0005 wt %, at least 0.001 wt %, and/or at least 0.003 wt %.

A10.2. The zinc alloy of any of paragraphs A10-A10.1, wherein the impurity combination includes lead and lead is at a concentration of less than 0.1 wt %, less than 0.05 wt %, less than 0.01 wt %, less than 0.005 wt %, less than 0.003 wt %, less than 0.002 wt %, less than 0.001 wt %, 0.1-0.001 wt %, 0.01-0.005 wt %, 0.005-0.001 wt %, at least 0.0005 wt %, at least 0.001 wt %, and/or at least 0.003 wt %.

A10.3. The zinc alloy of any of paragraphs A10-A10.2, wherein the impurity combination includes cadmium and cadmium is at a concentration of less than 0.1 wt %, less than 0.05 wt %, less than 0.01 wt %, less than 0.005 wt %, less than 0.003 wt %, less than 0.002 wt %, less than 0.001 wt %, 0.1-0.001 wt %, 0.01-0.005 wt %, 0.005-0.001 wt %, at least 0.0005 wt %, at least 0.001 wt %, and/or at least 0.003 wt %.

A10.4. The zinc alloy of any of paragraphs A10-A10.3, wherein the impurity combination includes tin and tin is at a concentration of less than 0.1 wt %, less than 0.05 wt %, less than 0.01 wt %, less than 0.005 wt %, less than 0.003 wt %, less than 0.002 wt %, less than 0.001 wt %, 0.1-0.001 wt %, 0.01-0.005 wt %, 0.005-0.001 wt %, at least 0.0005 wt %, at least 0.001 wt %, and/or at least 0.003 wt %.

A11. The zinc alloy of any of paragraphs A1-A10.4, wherein the zinc alloy is essentially free of at least one of, and optionally at least two, three, four, five, six, or all seven of, copper, magnesium, iron, nickel, lead, cadmium, and tin.

A11.1. The zinc alloy of paragraph A11, wherein the zinc alloy is free of at least one of, and optionally at least two, three, four, five, six, or all seven of, copper, magnesium, iron, nickel, lead, cadmium, and tin.

A11.2. The zinc alloy of any of paragraphs A11-A11.1, wherein the zinc alloy is essentially free of, optionally free of, at least one of, and optionally at least two or all three of, lead, cadmium, and tin.

A12. The zinc alloy of any of paragraphs A1-A11.2, wherein the zinc alloy comprises, by weight:

one or more of, and optionally two or more of, at most 3.5% Al, at most 0.025% Mg, at most 0.075% Fe, at least 4.3% Al, at least 0.08% Mg, and at least 0.1% Fe; and optionally at least 75%, at least 80%, at least 85%, at least 90%, at least 93%, at least 95%, 70-95%, 80-95%, 90-95%, 90-96%, and/or 90-98% Zn.

A12.1. The zinc alloy of paragraph A12, wherein the zinc alloy comprises, by weight: one or more of, and optionally two of more of, at most 3.5% Al, at most 0.025% Mg, and at most 0.075% Fe.

A12.2. The zinc alloy of any of paragraphs A12-A12.1, wherein the zinc alloy comprises, by weight:

at most 3.5% Al, at most 0.025% Mg, and/or at most 0.075% Fe.

A12.3. The zinc alloy of any of paragraphs A12-A12.2, wherein the zinc alloy comprises, by weight:

one or more of, and optionally two of more of, at least 4.3% Al, at least 0.08% Mg, and at least 0.1% Fe; and at least 75%, at least 80%, at least 85%, at least 90%, at least 93%, at least 95%, 70-95%, 80-95%, and/or 90-95% Zn.

A12.4. The zinc alloy of any of paragraphs A12-A12.3, wherein the zinc alloy comprises, by weight:

at least 4.3% Al, at least 0.08% Mg, and/or at least 0.1% Fe; and at least 75%, at least 80%, at least 85%, at least 90%, at least 93%, at least 95%, 70-95%, 80-95%, and/or 90-95% Zn.

A13. The zinc alloy of any of paragraphs A1-A12.4, wherein the zinc alloy comprises, by weight:

at most 4.0% Al;
at most 0.015% Mg;
at most 0.20% Cu;
optionally, at most 0.003% Pb;
optionally, at most 0.002% Cd;
optionally, at most 0.001% Sn;
at most 0.05% Fe; and
0.005%-0.15% Ni.

A14. The zinc alloy of any of paragraphs A1-A13, wherein the zinc alloy comprises, by weight:

2.45%-2.75% Al;
0.005%-0.02% Mg;
at most 0.25% Cu;
optionally, at most 0.003% Pb;
optionally, at most 0.002% Cd;
optionally, at most 0.001% Sn;
at most 0.075% Fe; and
0%-0.15% Ni.

A15. The zinc alloy of any of paragraphs A1-A14, wherein the zinc alloy comprises, by weight:

3.5%-4.3% Al;
0.005%-0.02% Mg;
at most 0.25% Cu;
optionally, at most 0.003% Pb;
optionally, at most 0.002% Cd;
optionally, at most 0.001% Sn;
at least 0.12%, at least 0.15%, at least 0.2%, at least 0.3%, at least 0.5%, 0.11-0.5%, and/or 0.12%-0.5% Fe;
0.005%-0.02% Ni; and at least 75%, at least 80%, at least 85%, at least 90%, at least 93%, at least 95%, 70-95%, 80-95%, 90-95%, and/or 90-96% Zn;

wherein the zinc alloy has a hardness of at least 10 BHN, at least 20 BHN, at least 30 BHN, at least 40 BHN, about 60 BHN, about 45 BHN, about 36 BHN, about 30 BHN, less than 60 BHN, less than 50 BHN, less than 40 BHN, and/or less than 30 BHN.

A16. The zinc alloy of any of paragraphs A1-A15, wherein the zinc alloy comprises, by weight:

at least 0.12%, at least 0.15%, at least 0.2%, at least 0.3%, at least 0.5%, 0.11-0.5%, and/or 0.12-0.5% Fe; and at least 0.001%, at least 0.002%, at least 0.003%, at least 0.005%, at least 0.01%, at least 0.02%, 0.001-0.02%, 0.005-0.01%, less than 0.1%, and/or less than 0.05% Ni.

A16.1. The zinc alloy of paragraph A16, wherein the zinc alloy comprises, by weight:

3.5%-4.3% Al;
0.025%-0.05% Mg;
at most 0.25% Cu;
optionally, at most 0.005% Pb;
optionally, at most 0.004% Cd; and
optionally, at most 0.003% Sn.

A17. The zinc alloy of any of paragraphs A1-A16.1, wherein the zinc alloy comprises, by weight:

3.5%-4.3% or 3.9%-4.3% Al;
0.025%-0.05% Mg;
at most 0.25% Cu;
optionally, at most 0.005% Pb;
optionally, at most 0.004% Cd;
optionally, at most 0.003% Sn;
at least 0.12% Fe; and at least 75%, at least 80%, at least 85%, at least 90%, at least 93%, at least 95%, 70-95%, 80-95%, 90-95%, and/or 90-96% Zn.

A18. The zinc alloy of any of paragraphs A1-A17, wherein the zinc alloy comprises, by weight:

3.5%-5.1% Al;
at least 0.05% or at least 0.08% Mg;
optionally, at most 0.25% Cu;
optionally, at most 0.005% Pb;
optionally, at most 0.004% Cd;
optionally, at most 0.003% Sn;
at least 0.05% Fe; and at least 75%, at least 80%, at least 85%, at least 90%, at least 93%, at least 95%, 70-95%, 80-95%, 90-95%, and/or 90-96% Zn.

A18.1. The zinc alloy of paragraph A18, wherein the zinc alloy comprises at least 0.12% Fe.

A18.2. The zinc alloy of any of paragraphs A18-A18.1, wherein the zinc alloy comprises at most 0.1% Fe.

A18.3. The zinc alloy of any of paragraphs A18-A18.2, wherein the zinc alloy comprises 3.5%-4.3% Al.

A18.4. The zinc alloy of any of paragraphs A18-A18.3, wherein the zinc alloy comprises 3.9%-4.3% Al.

A18.5. The zinc alloy of any of paragraphs A18-A18.4, wherein the zinc alloy comprises 3.9%-5.1% Al.

A18.6. The zinc alloy of any of paragraphs A18-A18.5, wherein the zinc alloy comprises 4.4%-5.1% Al.

A18.7. The zinc alloy of any of paragraphs A18-A18.6, wherein the zinc alloy comprises 4.9%-5.1% Al.

A19. The zinc alloy of any of paragraphs A1-A18.7, wherein the zinc alloy comprises, by weight:

4.4%-5.1% Al;
0.025%-0.05% Mg;
at most 0.25% Cu;
optionally, at most 0.005% Pb;

optionally, at most 0.004% Cd;

optionally, at most 0.003% Sn; and at most 0.1%, at most 0.12%, at most 0.15%, or at most 0.2% Fe.

A19.1. The zinc alloy of paragraph A19, wherein the zinc alloy comprises 4.65%-4.95% Al.

A19.2. The zinc alloy of any of paragraphs A19-A19.1, wherein the zinc alloy comprises 4.9%-5.1% Al.

A20. The zinc alloy of any of paragraphs A1-A19.2, wherein the zinc alloy is a ballistic zinc alloy.

A21. The zinc alloy of any of paragraphs A1-A20, wherein the zinc alloy is at least one of a frangible zinc alloy and a ductile zinc alloy.

A22. The zinc alloy of any of paragraphs A1-A21, wherein the zinc alloy has an ultimate tensile strength of 200-420 MPa, 240-380 MPa, 270-350 MPa, at least 200 MPa, at least 240 MPa, at least 270 MPa, at least 310 MPa, at least 340 MPa, less than 420 MPa, less than 350 MPa, less than 310 MPa, and/or less than 280 MPa.

A23. The zinc alloy of any of paragraphs A1-A22, wherein the zinc alloy has a yield strength of at least 200-420 MPa, 240-380 MPa, 270-350 MPa, at least 70 MPa, at least 200 MPa, at least 240 MPa, at least 270 MPa, at least 310 MPa, at least 340 MPa, less than 420 MPa, less than 350 MPa, less than 310 MPa, less than 280 MPa, and/or less than 200 MPa.

A24. The zinc alloy of any of paragraphs A1-A23, wherein the zinc alloy has a percent elongation at fracture of 4-30%, 5-30%, 7.5-20%, 10-25%, 6-40%, 8-30%, 12-30%, 10-20%, at least 5%, at least 10%, at least 12%, at least 15%, at least 20%, at least 25%, at least 30%, less than 40%, less than 30%, less than 25%, less than 20%, and/or less than 15%.

A25. The zinc alloy of any of paragraphs A1-A24, wherein the zinc alloy has a shear strength of at least 160 MPa, at least 180 MPa, at least 200 MPa, less than 280 MPa, less than 220 MPa, less than 200 MPa, and/or less than 180 MPa.

A26. The zinc alloy of any of paragraphs A1-A25, wherein the zinc alloy has a hardness of at least 10 BHN, at least 20 BHN, at least 30 BHN, at least 40 BHN, less than 60 BHN, less than 50 BHN, less than 40 BHN, and/or less than 30 BHN.

A27. The zinc alloy of any of paragraphs A1-A26, wherein the zinc alloy has a composition that differs from a Zamak alloy composition.

A28. The zinc alloy of any of paragraphs A1-A27, wherein any of the preceding individual and/or collective concentrations are "about" the value recited in the preceding paragraphs.

A29. The use of the zinc alloy of any of paragraphs A1-A28 as at least one of a firearm projectile, a portion of a firearm projectile, a component of a firearm cartridge, a bullet, a nose portion of a bullet, a core of a firearm projectile, and a shot pellet.

B1. A firearm projectile including the zinc alloy of any of paragraphs A1-A28.

B2. The firearm projectile of paragraph B1, wherein the firearm projectile is at least one of a bullet, a slug, a pellet, shot, and a shot pellet, and optionally wherein the firearm projectile is configured to be received within a standard firearm cartridge.

B3. The firearm projectile of any of paragraphs B1-B2, wherein the firearm projectile is at least one of a frangible firearm projectile, a ductile firearm projectile, a hollow-point firearm projectile, an expanding firearm projectile, and a mushrooming firearm projectile.

B4. The firearm projectile of any of paragraphs B1-B3, wherein the firearm projectile includes a nose portion that includes the zinc alloy of any of paragraphs A1-A28.

B4.1. The firearm projectile of paragraph B4, wherein the nose portion consists essentially of the zinc alloy of any of paragraphs A1-A28.

B5. The firearm projectile of any of paragraphs B1-B4.1, wherein the firearm projectile includes a core that includes the zinc alloy of any of paragraphs A1-A28.

B5.1. The firearm projectile of paragraph B5, wherein the core consists essentially of the zinc alloy of any of paragraphs A1-A28.

B6. The firearm projectile of any of paragraphs B1-B5.1, wherein the firearm projectile includes a shank portion.

B6.1. The firearm projectile of paragraph B6 wherein the shank portion consists essentially of materials other than the zinc alloy of any of paragraphs A1-A28.

B6.2. The firearm projectile of any of paragraphs B6-B6.1, when depending from B4 or B4.1, wherein the shank portion consists essentially of a different material than the nose portion.

B6.3. The firearm projectile of any of paragraphs B6-B6.2, wherein the shank portion includes at least one of steel and copper.

B6.4. The firearm projectile of any of paragraphs B6-B6.3, wherein the shank portion consists essentially of at least one of steel and copper-clad steel.

B7. The firearm projectile of any of paragraphs B1-B6.4, wherein the firearm projectile includes a jacket.

B7.1. The firearm projectile of paragraph B7, wherein the jacket includes at least one of gilding metal and copper.

B7.2. The firearm projectile of any of paragraphs B7-B7.1, wherein the jacket consists essentially of at least one of gilding metal and copper.

B8. The firearm projectile of any of paragraphs B1-B7.2, wherein the firearm projectile includes at least one of an exterior coating and a surface coating.

B9. The firearm projectile of any of paragraphs B1-B8, wherein the firearm projectile is configured to mushroom upon impact with a target.

B9.1. The firearm projectile of paragraph B9, wherein the firearm projectile has a diameter and wherein the firearm projectile is configured to expand in diameter by an amount selected from the group of at least 10%, at least 25%, at least 50%, at least 75%, and at least 100%, upon impact with the target.

B9.2. The firearm projectile of any of paragraphs B9-B9.1, wherein the impact is impact with ordinance gelatin.

B9.3. The firearm projectile of any of paragraphs B9-B9.2, wherein the impact results from firing the firearm projectile from a firearm, optionally at a speed of about 750 m/s.

B10. The firearm projectile of any of paragraphs B1-B9.3, wherein the firearm projectile is configured to fragment into particles upon impact with a target.

B10.1. The firearm projectile of paragraph B10, wherein the maximum size of the particles is 5 grains, 0.324 g, 0.33 g, and/or 0.3 g.

B10.2. The firearm projectile of any of paragraphs B10-B10.1, wherein the impact is impact with a steel target.

B10.3. The firearm projectile of any of paragraphs B10-B10.2, wherein the impact results from firing the firearm projectile from a firearm, optionally at a speed of about 750 m/s.

B11. The firearm projectile of any of paragraphs B1-B10.3, wherein the firearm projectile is heat treated, optionally wherein the firearm projectile has been subjected to a temperature of 90° C.-120° C. for a period of at least 2 hours and/or less than 6 hours.

C1. A firearm cartridge, comprising:

a casing adapted to be received into a firearm;

a primer and a propellant within the casing; and the firearm projectile of any of paragraphs B1-B11, wherein the firearm projectile is at least partially received into the casing.

C2. The firearm cartridge of paragraph C1, wherein the firearm cartridge is at least one of a bullet cartridge, a shot shell, a shot cartridge, a slug shell, and a slug cartridge.

C3. The firearm cartridge of any of paragraphs C1-C2, wherein the firearm cartridge comprises a plurality of the firearm projectiles.

Unless otherwise specified, any compositional percentages provided herein are in weight percent, or "wt %." When ranges or maximum/minimum bounds for a property or other value are presented herein, it is within the scope of the present disclosure that the value additionally or alternatively may be within a range that is bounded by any of the disclosed maximum/minimum (at least, less then, etc.) values and/or may be a value that is within any of the disclosed ranges/bounds. For example, a value of 5-10, at least 4, and less than 15 may include such illustrative values as 3, 4, 4.2, 5.1, 6, 9, 10, 10.5, 14, 15, and 16, as well as such ranges as 4-10, 5-15, and 4-15.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, when the disclosure or subsequently filed claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

INDUSTRIAL APPLICABILITY

The systems and methods disclosed herein are applicable to the firearm and ammunition fields.

The invention claimed is:

1. A firearm cartridge, comprising:
a casing adapted to be received into a firearm;
a primer and a propellant within the casing; and
a cast unitary bullet at least partially received into the casing, wherein the bullet is at least substantially formed from a ballistic zinc alloy that comprises, by weight:
90%-98% Zn;
2.0%-4.1% Al; and
one or more of at most 0.025% Mg, at most 0.075% Fe, at least 0.08% Mg, and at least 0.1% Fe.

2. The firearm cartridge of claim 1, wherein the ballistic zinc alloy has a percent elongation at fracture of at least 10%.

3. The firearm cartridge of claim 1, wherein the ballistic zinc alloy has a hardness of at least 10 BHN and less than 60 BHN.

4. The firearm cartridge of claim 1, wherein the ballistic zinc alloy has an ultimate tensile strength of at least 200 MPa.

5. The firearm cartridge of claim 1, wherein the ballistic zinc alloy has a yield strength of at least 70 MPa.

6. The firearm cartridge of claim 1, wherein the bullet is a frangible bullet.

7. The firearm cartridge of claim 1, wherein the bullet is a mushrooming bullet.

8. The firearm cartridge of claim 7, wherein the mushrooming bullet includes a nose portion that consists essentially of the ballistic zinc alloy.

9. The firearm cartridge of claim 8, wherein the mushrooming bullet includes a shank portion that consists essentially of materials other than the ballistic zinc alloy.

10. The firearm cartridge of claim 1, wherein the bullet is a heat treated bullet that has been subjected to a temperature of 90° C.–120° C. for a period of at least 2 hours and less than 6 hours.

11. The firearm cartridge of claim 1, wherein the ballistic zinc alloy comprises, by weight, 0.02%-0.5% magnesium.

12. The firearm cartridge of claim 1, wherein the ballistic zinc alloy comprises, by weight, 0.05%-0.75% iron.

13. A firearm cartridge, comprising:
a casing adapted to be received into a firearm;
a primer and a propellant within the casing; and
a cast unitary firearm projectile at least partially received into the casing, wherein the firearm projectile is a frangible firearm projectile that is at least substantially formed from a ballistic zinc alloy that comprises, by weight:
90%-98% Zn;
4.4%-5.1% Al; and
one or more of at most 0.025% Mg, at most 0.075% Fe, at least 0.08% Mg, and at least 0.1% Fe.

14. The firearm cartridge of claim 13, wherein the ballistic zinc alloy has a percent elongation at fracture of at least 10%.

15. The firearm cartridge of claim 13, wherein the ballistic zinc alloy has a hardness of at least 10 BHN and less than 60 BHN.

16. The firearm cartridge of claim 13, wherein the ballistic zinc alloy has an ultimate tensile strength of at least 200 MPa.

17. The firearm cartridge of claim 13, wherein the ballistic zinc alloy has a yield strength of at least 70 MPa.

18. The firearm cartridge of claim 13, wherein the firearm projectile is a frangible bullet.

19. The firearm cartridge of claim 18, wherein the frangible bullet includes a nose portion that consists essentially of the ballistic zinc alloy.

20. The firearm cartridge of claim 19, wherein the nose portion is frangible.

21. The firearm cartridge of claim 19, wherein the frangible bullet includes a shank portion that consists essentially of materials other than the ballistic zinc alloy.

22. The firearm cartridge of claim 13, wherein the firearm projectile is a heat treated firearm projectile that has been subjected to a temperature of 90° C.–120° C. for a period of at least 2 hours and less than 6 hours.

23. The firearm cartridge of claim 13, wherein the ballistic zinc alloy further comprises copper.

24. The firearm cartridge of claim 23, wherein the ballistic zinc alloy comprises, by weight, less than 3% copper.

25. The firearm cartridge of claim 13, wherein the ballistic zinc alloy comprises, by weight, 0.02%-0.5% magnesium.

26. The firearm cartridge of claim 13, wherein the ballistic zinc alloy —comprises, by weight, 0.05%-0.75% iron.

* * * * *